US006790086B1

(12) United States Patent
Lo

(10) Patent No.: US 6,790,086 B1
(45) Date of Patent: Sep. 14, 2004

(54) ELECTRICAL PLUG

(75) Inventor: Jeng-Huel Lo, Taichung Hsien (TW)

(73) Assignee: Cheng Kun Electric Co., Ltd., Taichung Hsien (TW)

( * ) Notice: Subject to any disclaimer, the term of this patent is extended or adjusted under 35 U.S.C. 154(b) by 0 days.

(21) Appl. No.: 10/327,393

(22) Filed: Dec. 24, 2002

(51) Int. Cl.[7] ..... H01R 13/40

(52) U.S. Cl. ..... 439/599; 439/284; 439/707; 439/752; 439/906; 439/652; 439/222; 439/956

(58) Field of Search ..... 439/597–599, 439/222, 284, 707–708, 652, 752, 906, 952, 904, 956

(56) References Cited

U.S. PATENT DOCUMENTS 3,344,392 A * 9/1967 Briscoe ..... 439/599
4,274,698 A * 6/1981 Ahroni ..... 439/622
4,781,614 A * 11/1988 Ahroni ..... 439/391
5,139,438 A * 8/1992 Gaffney ..... 439/269.2
5,885,109 A * 3/1999 Lee et al. ..... 439/652
6,328,581 B1 * 12/2001 Lee et al. ..... 439/106
6,454,576 B1 * 9/2002 Hedrick et al. ..... 439/105

* cited by examiner

*Primary Examiner*—Truc Nguyen
(74) *Attorney, Agent, or Firm*—Harrison & Egbert

(57) ABSTRACT

An electrical plug includes a first insulating body, a first prong extending from one end of the first insulating body, a second insulating body, and a second prong extending from one end of the second insulating body. The first insulating body and the second insulating body are separably held together so as to enable the first prong and the second prong to fit into the electrical outlets of various specifications.

5 Claims, 9 Drawing Sheets

ELECTRICAL PLUG

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an electrical plug, and more particularly to an electrical plug compatible with the outlets of various specifications.

BACKGROUND OF THE INVENTION

The conventional electrical plug comprises an insulating body, two prongs projecting from one end of the insulating body, and a cord fastened to the other end of the insulating body. The two prongs are fixedly projected from the one end of the insulating body and can be therefore fitted into an outlet of certain specifications. In light of the outlet specifications being different from country to country, the conventional electrical plug is limited in its use. Such a limitation in use of the conventional electrical plug often brings about inconvenience to an international traveler.

BRIEF SUMMARY OF THE INVENTION

The primary objective of the present invention is to provide an electrical plug which is free of the shortcoming of the conventional electrical plug described above.

In keeping with the principle of the present invention, the foregoing objective of the present invention is attained by an electrical plug comprising two insulating bodies and two prongs which are projected respectively from one end of the insulating bodies and are connected to a bonding wire. The two insulating bodies are separably held together so as to enable the two prongs to be fitted into outlets of various specifications.

The features and the advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
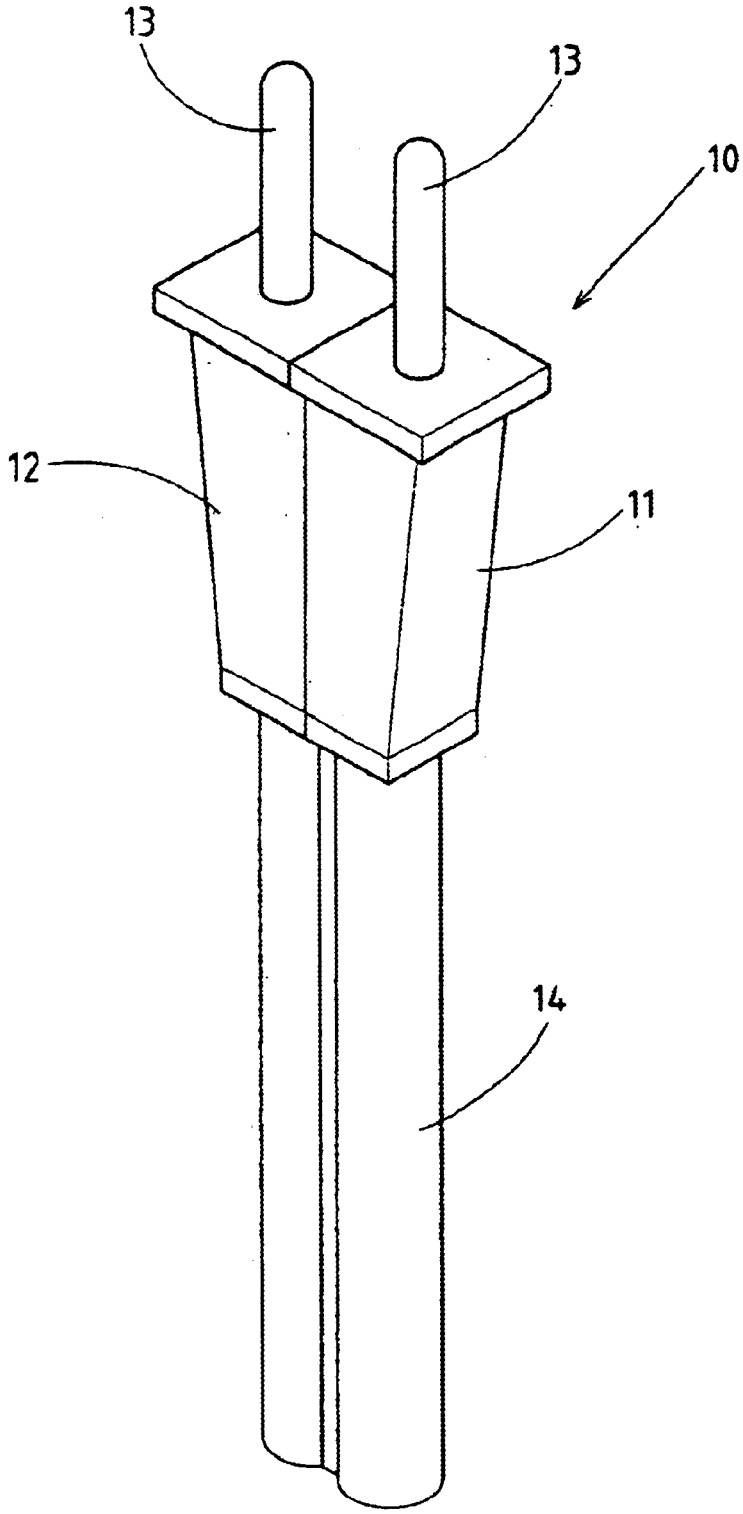
FIG. 1 shows a perspective view of a first preferred embodiment of the present invention.
Figure 2:
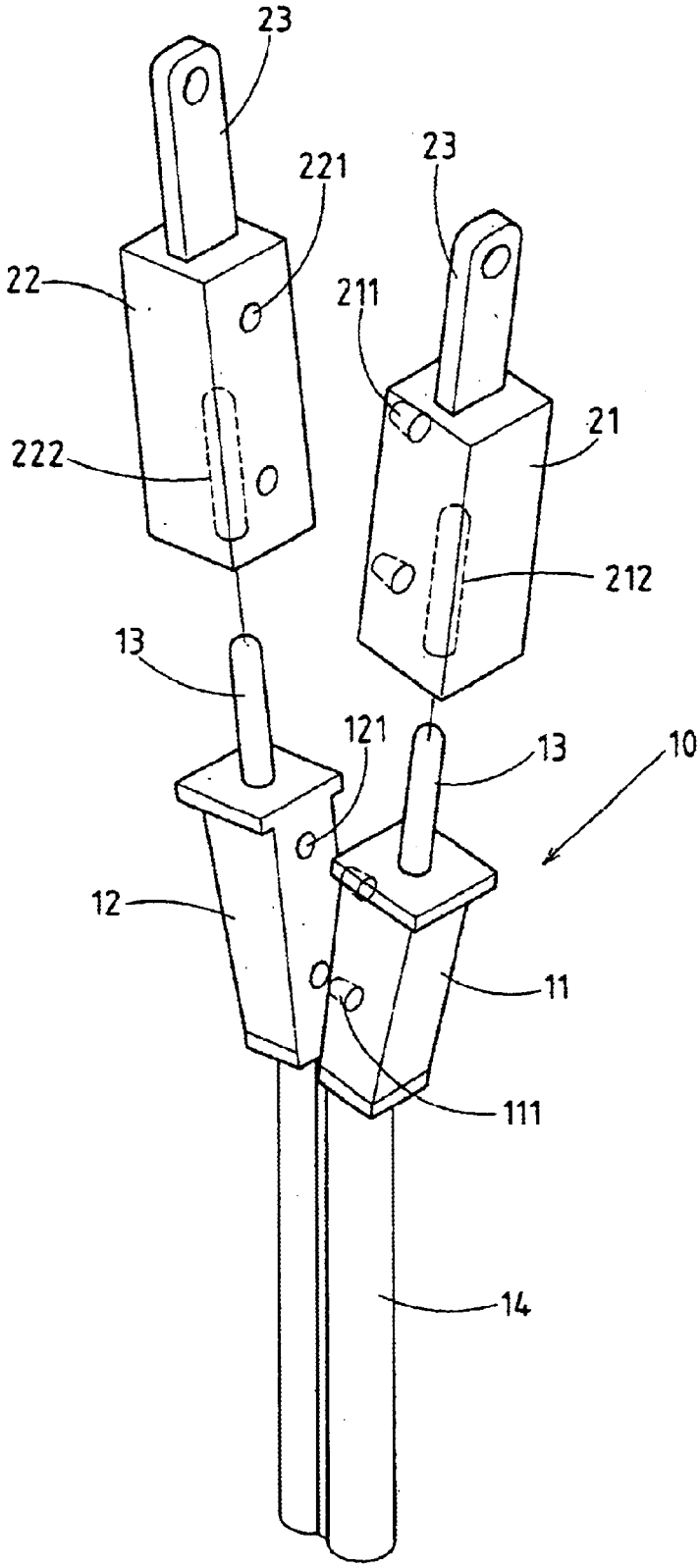
FIG. 2 shows an exploded perspective view of the first preferred embodiment of the present invention.
Figure 3:
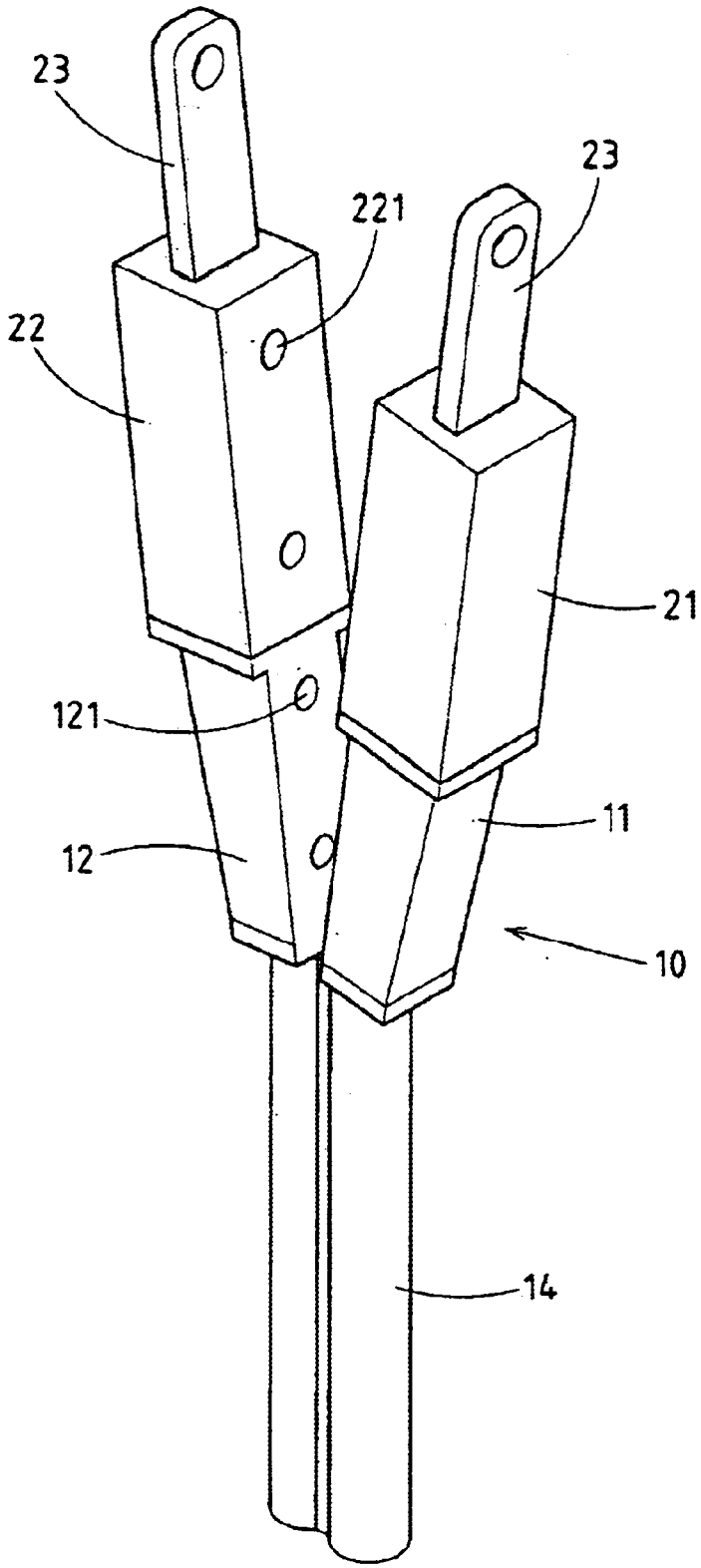
FIG. 3 shows another perspective view of the first preferred embodiment of the present invention.
Figure 4:
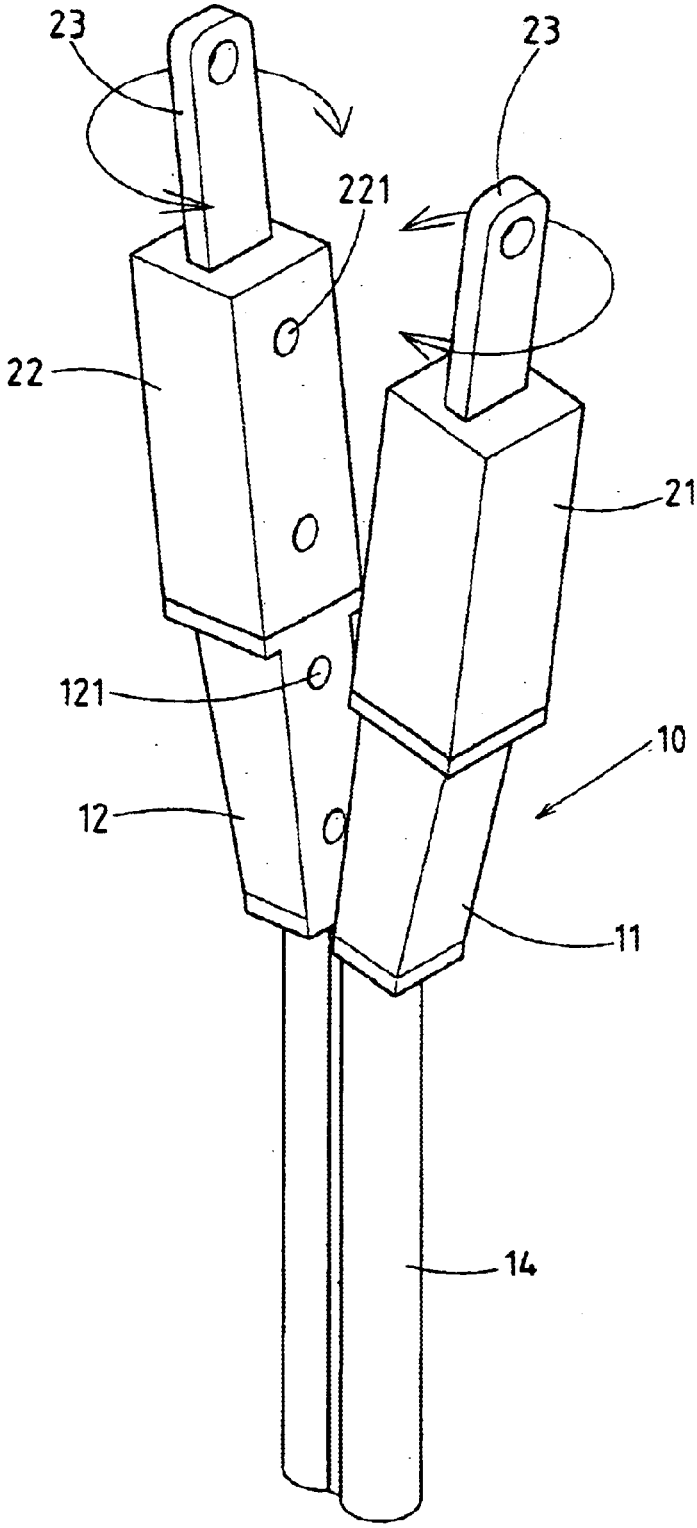
FIGS. 4 and 5 are schematic views of the first preferred embodiment of the present invention in use.
Figure 5:
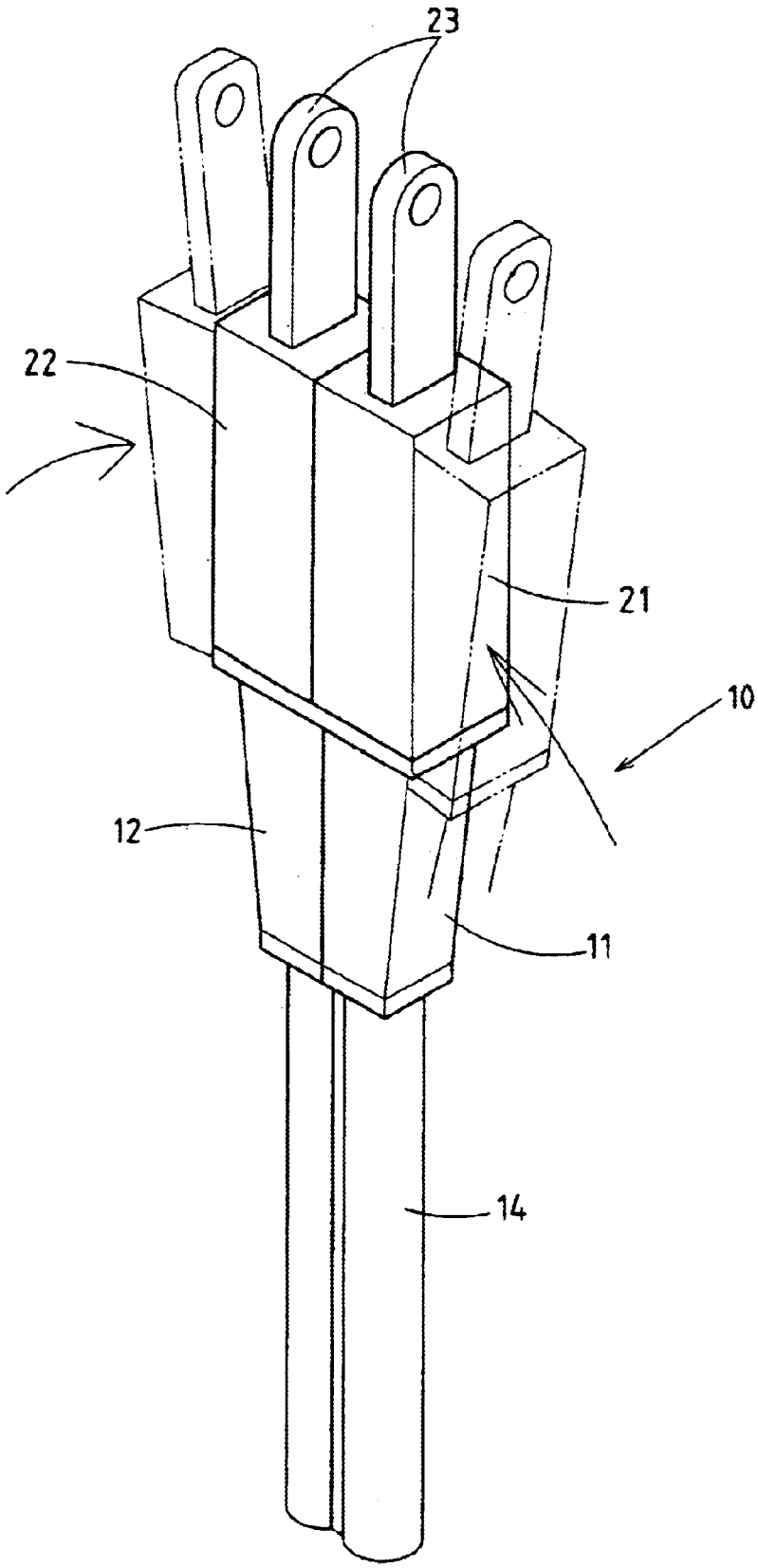

As shown in FIGS. 1–5, an electrical plug 10 embodied in the present invention comprises a first insulating body 11, a second insulating body 12, and two prongs 13 projecting respectively from one end of the two insulating bodies 11 and 12 such that the two prongs 13 are connected to a bonding wire 14 which is fastened to the other end of the two insulating bodies 11 and 12. The two insulating bodies 11 and 12 are separably held together, as shown in FIG. 2. The first insulating body 11 is provided with a plurality of retaining slots 11, while the second insulating body 12 is provided with a plurality of retaining projections 121 opposite to the retaining slots 111 of the first insulating body 11. These two insulating bodies 11 and 12 are separably held together such that the retaining projections 121 of the second insulating body 12 are separably retained in the retaining slots 111 of the first insulating body 11. The electrical plug 10 of the present invention further comprises a first extension insulation body 21 and a second extension insulation body 22, which are basically similar in construction to the first insulating body 11 and the second insulating body 12, with the difference being that the prongs 23 of the two extension insulation bodies 21 and 22 are different in cross sectional profile from the prongs 13 of the two insulating bodies 11 and 12, and that the two extension insulation bodies 21 and 22 are respectively provided with an insertion hole 212, 222.

The first extension insulation body 21 is provided with a plurality of retaining slots 211, while the second extension insulation body 22 provided with a plurality of retaining projections 221 opposite to the retaining slots 211 of the first extension insulation body 21. The first extension insulation body 21 is removably joined with the first insulating body 11 in such a way that the prong 13 of the first insulating body 11 is removably inserted into the insertion hole 212 of the first extension insulation body 21, and that the prong 13 is electrically connected to the prong 23 of the first extension insulation body 21. Similarly, the second extension insulation body 22 is removably joined with the second insulating body 12 and is separably held together with the first extension insulation body 21 by the retaining projections 221 which are separably retained in the retaining slots 211 of the first extension insulation body 21.

Figure 10:
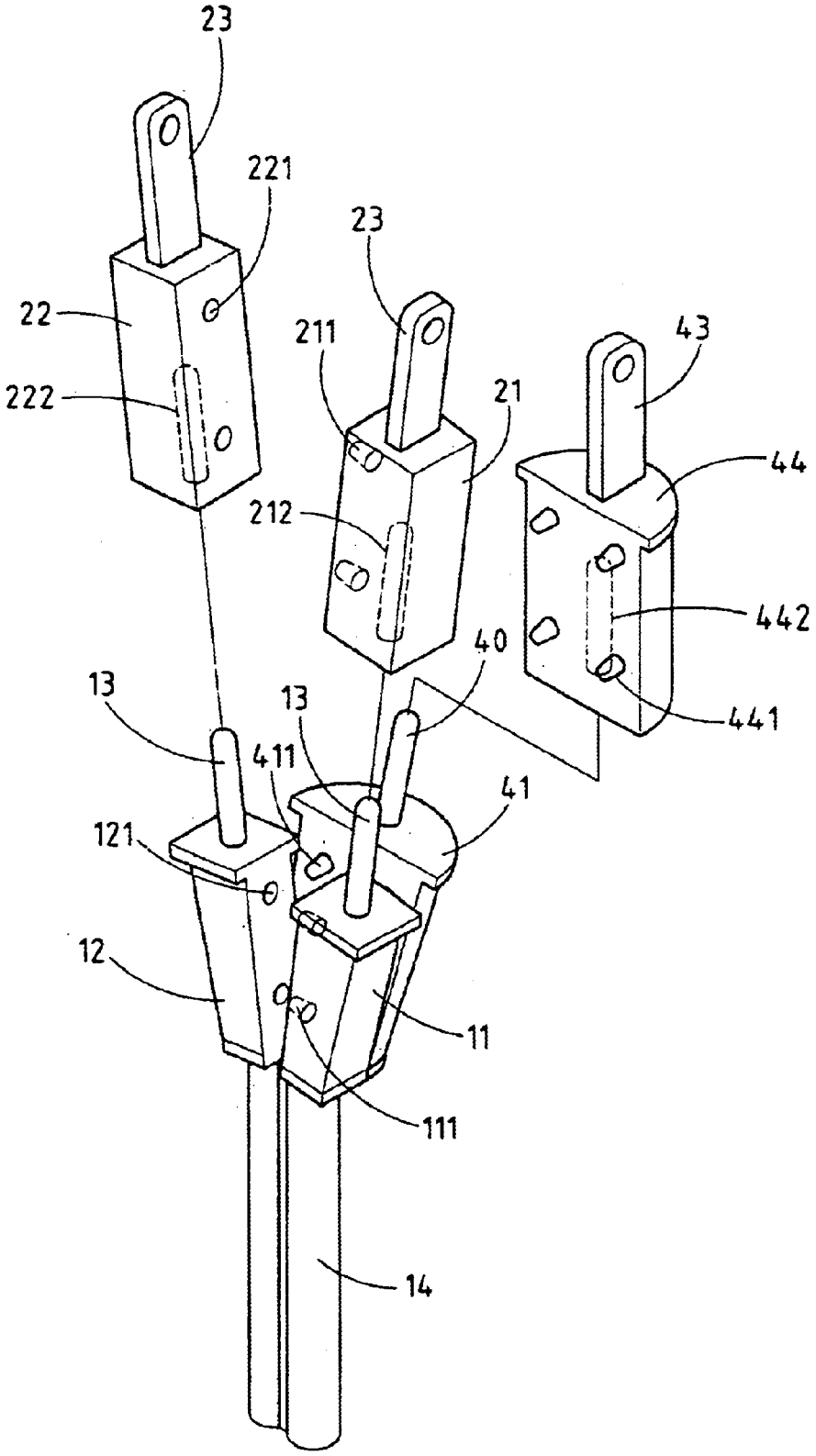
FIG. 10 shows an exploded perspective view of a second preferred embodiment of the present invention.
Figure 11:
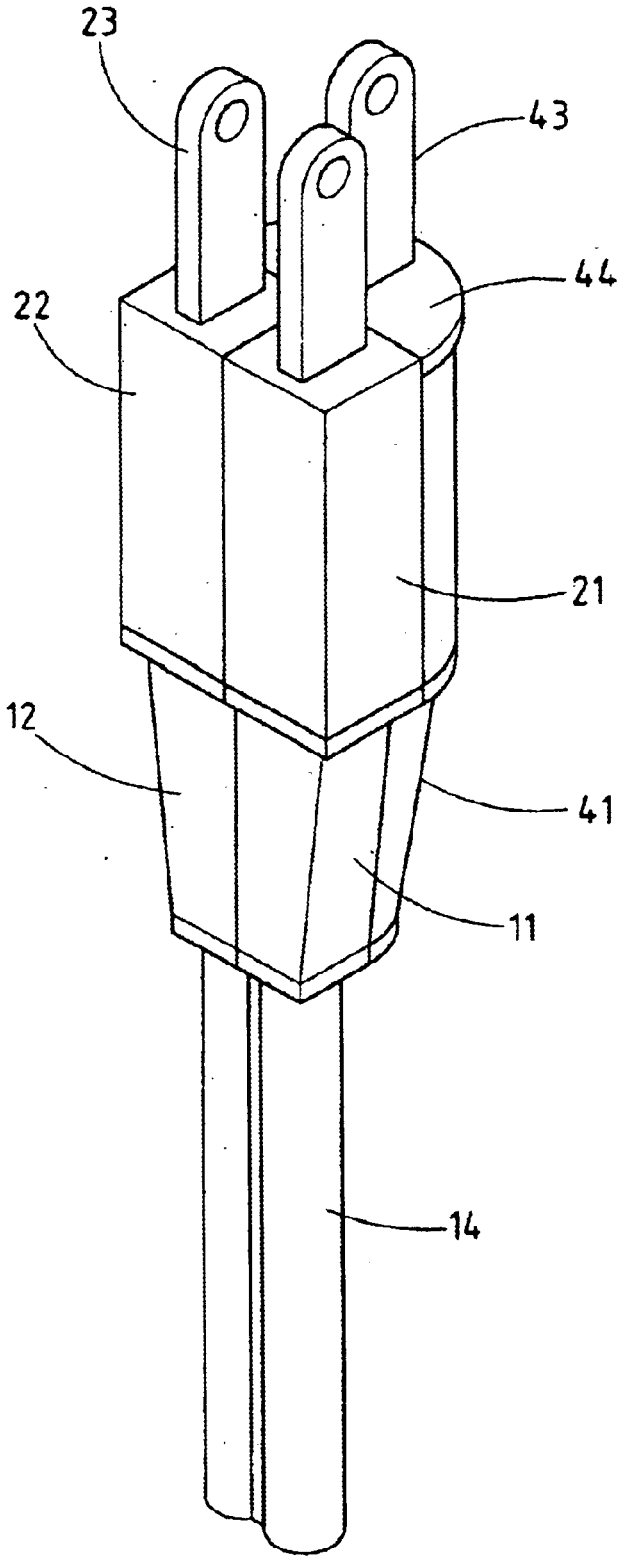
FIG. 11 shows a perspective view of the second preferred embodiment of the present invention.

As shown in FIGS. 10 and 11, an electrical plug of the second preferred embodiment of the present invention comprises a first insulating body 11, a second insulating body 12, a grounding insulating body 41, and prongs 13 and 40 which are respectively projected from one end of the insulating bodies 11, 12, and 41. A bonding wire 14 is fastened to the other end of the insulating bodies 11, 12, and 41 and is connected with the prongs 13 and 40.

The electrical plug of the second preferred embodiment of the present invention further comprises a first extension insulation body 215 a second extension insulation body 22, and a grounding extension insulation body 44. These three extension insulation bodies 21, 22, and 44 are basically similar in construction to the three insulating bodies 11, 12, and 41, with the difference being that the prongs 13 and 40 of the three insulating bodies 11, 12 and 41 arc different in cross sectional profile from prongs 23 and 43 of the three extension insulation bodies 21, 22 and 44, and that the three extension insulation bodies 21, 22 and 44 are respectively provided with an insertion hole 212, 222, 442, which are dimensioned to accommodate respectively the prongs 13 of the first insulating body 11 and the second insulating body 22, and the grounding prong 40 of the grounding insulating body 41.

The three extension insulation bodies 21,22 and 44 are respectively provided with a plurality of retaining portions 211,221,441, by which the three extension insulation bodies 21, 22 and 44 are separably held together as a unit, as illustrated in FIG. 11.

Figure 6:
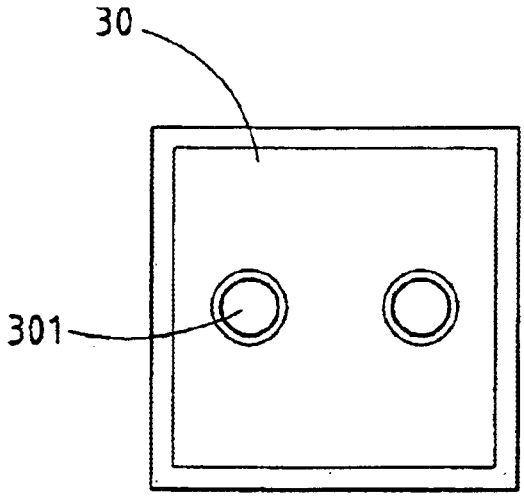
FIGS. 6–9 are schematic plan views of electrical outlets of various specifications.
Figure 7:
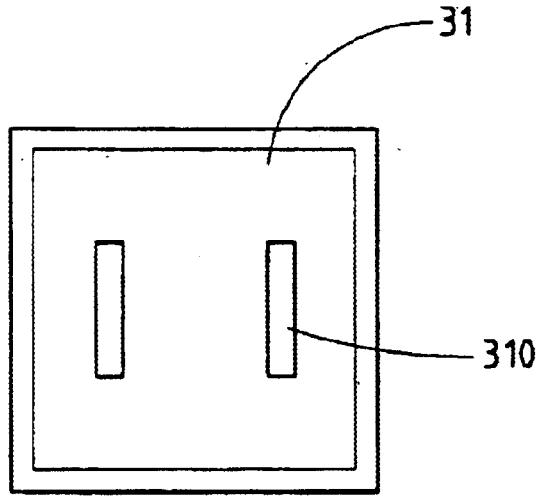

The electrical plug of the first preferred embodiment of the present invention is compatible with two outlets 30 and 31, as shown in FIGS. 6 and 7. The first outlet 30 is provided with two first prong slots 301 while the second outlet 31 is provided with two second prong slots 310 different in cross sectional profile from the two first prong slots 301.

Figure 8:
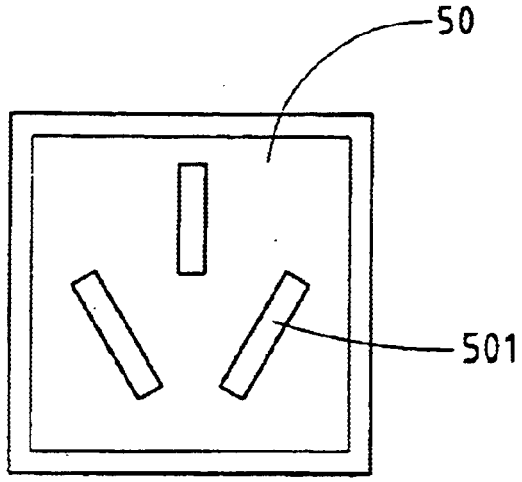
Figure 9:
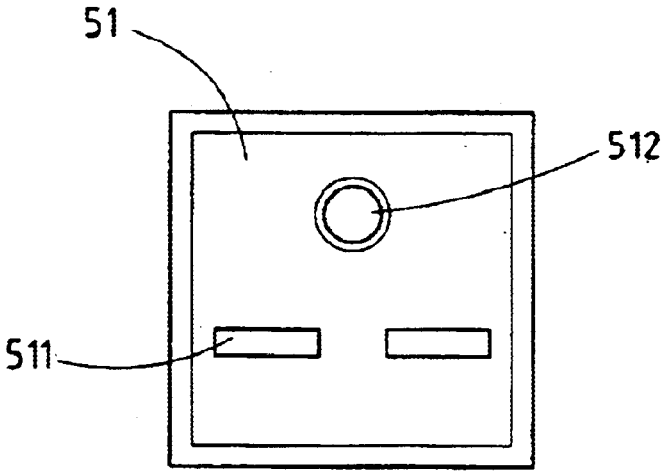

The electrical plug of the second preferred embodiment of the present invention is compatible with two outlets 50 and 51, as shown in FIGS. 8 and 9. The first outlet 50 is provided with three rectangular prong slots 501, while the second outlet 51 is provided with two rectangular prong slots 511, and one round prong slot 512.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. An electrical plug comprising:

a first insulating body provided in one side with at least one retaining portion;

a first prong extending from one end of said first insulating body, said first prong having a circular cross-section;

a second insulating body provided with at least one retaining portion opposite to said retaining portion of said first insulating body whereby said second insulating body is separately held together with said first insulating body such that the retaining portion of said second insulating body and the retaining portion of said first insulating body are separately engaged with each other; and a second prong extending from one end of said second insulating body, said second prong having a circular cross-section; and a first extension insulation body:

a first prong extending from one end of said first extension insulation body, said first prong of said first extension insulation body being of a rectangular cross section, said first extension insulation body being provided at another end with an insertion slot dimensioned to accommodate said first prong of said first insulating body such that said first prong is rotatable within said insertion slot, said first extension insulation body further provided in one side thereof with at least one retaining portion whereby said first extension insulation body is removably mounted on said first insulating body in such a way that said first prong of said first insulating body is removable inserted into said insertion slot of said first extension insulation body;

a second extension insulation body; and a second prong extending from one end of said second extension insulation body, said second prong of said second extension insulation body being of a rectangular cross-section, said second extension insulation body being provided at another end with an insertion slot dimensioned to accommodate said second prong of said second insulating body such that said second prong is rotatable within said insertion slot of said second extension insulation body, said second extension insulation body further provided with at least one retaining portion opposite to the retaining portion of said first extension insulation body whereby said second extension insulation body is removably mounted on said second insulating body in such a way that said second prong of said second insulating body is removably inserted into said insertion slot of said second extension insulation body, said second extension insulation body is separately held together with said first extension insulation body by the retaining portion of said second extension insulation body which is separately engaged with the retaining portion of said first extension insulation body.

2. The electrical plug as defined in claim 1, wherein said first prong of said first extension insulation body and said second prong of said second extension insulation body are identical in cross sectional profile with each other and are different in cross sectional profile from said first prong of said first insulating body and said second prong of said second insulating body.

3. An electrical plug comprising:

a first insulating body provided in one side with at least one retaining portion;

a first prong extending from one end of said first insulating body, said first prong having a circular cross-section;

a second insulating body provided with at least one retaining portion opposite to said retaining portion of said first insulating body whereby said second insulating body is separately held together with said first insulating body in such a manner that the retaining portion of said second insulating body and the retaining portion of said first insulating body are separately engaged with each other;

a second prong extending from one end of said second insulating body, said second prong being of a circular cross-section;

a grounding insulating body provided with at least two retaining portions opposite respectively to the retaining portion of said first insulating body and the retaining portion of said second insulating body whereby said grounding insulating body is separately held together with said first insulating body and said second insulating body in such a way that the two retaining portions of said grounding insulating body are engaged separately and respectively with the retaining portion of said first insulating body and the retaining portion of said second insulating body; and a grounding prong extending from one end of said grounding insulating body, said grounding prong being of a circular cross-section;

a first extension insulation body;

a first extension prong extending from one end of said first extension insulation body, said first extension prong having a rectangular cross-section, said first extension insulation body being provided at another end with an insertion slot dimensioned to accommodate said first prong of said first insulation body such that said first prong is rotatable received in said insertion slot, said first extension insulation body further provided in one side with at least one retaining portion whereby said first extension insulation body is removably mounted on said first insulating body such that said first prong of said first insulating body is removably inserted into said insertion slot of said first extension insulation body;

a second extension insulation body;

a second extension prong extending from one end of said second extension insulation body, said second extension prong having a rectangular cross-section, said second extension insulation body being provided at another end with an insertion slot dimensioned to accommodate said second prong of said second insulating body such that said second prong is rotatably received in said insertion slot of said second extension insulation body, said second extension insulation body further provided with at least one retaining portion opposite to the retaining portion of said first extension insulation body whereby said second extension insulation body is removably mounted on said second insulating body such that said second prong of said second insulating body is removably inserted into said insertion slot of said second extension insulation body, and that said second extension insulation body is separately held together with said first extension insulation body by the retaining portion of said second extension insulation body which is separably engaged with the retaining portion of said first extension insulation body;

a grounding extension insulation body; and a grounding extension prong extending from one end of said grounding extension insulation body, said grounding extension prong having a rectangular cross-section, said grounding extension insulation body being provided at another end with an insertion slot dimensioned to accommodate said grounding prong of said grounding insulating bodys such that said grounding prong is rotatably received in said insertion slot of said grounding extension insulation body, said grounding extension insulation body further provided with at least two retaining portions opposite to the retaining portions of said first extension insulation body and said second extension insulation body whereby said grounding extension insulation body is removably mounted on said grounding insulating body such that said grounding prong of said grounding insulating body is removably inserted into said insertion slot of said grounding extension insulation body, and that said grounding extension insulation body is separately held together with said first extension insulation body and said second extension insulation body by said two retaining portions of said grounding extension insulation body which are engaged separately and respectively with the retaining portion of said first extension insulation body and said retaining portion of said second extension insulation body.

4. The electrical plug as defined in claim 3, wherein said first extension prong of said first extension insulation body and said second extension prong of said second extension insulation body are different in cross section from said first prong of said first insulating body and said second prong of said second insulating body.

5. The electrical plug as defined in claim 4, wherein said grounding extension prong of said grounding extension insulation body is different in cross section from said grounding extension prong of said insulating body.

* * * * *